US012606970B1

(12) United States Patent
Bassari

(10) Patent No.: US 12,606,970 B1
(45) Date of Patent: Apr. 21, 2026

(54) GROUND REINFORCEMENT FOUNDATION PILES COMBINABLE IN DIFFERENT FORMS DEPENDING ON GROUND CONDITIONS

(71) Applicant: GALIP USA LLC, Houston, TX (US)

(72) Inventor: Saeid Bassari, Georgetown, TX (US)

(73) Assignee: GALIP USA LLC, Houston, TX (US)

( * ) Notice: Subject to any disclaimer, the term of this patent is extended or adjusted under 35 U.S.C. 154(b) by 0 days.

(21) Appl. No.: 19/071,058

(22) Filed: Mar. 5, 2025

(51) Int. Cl.

| | |
|---|---|
| ***E02D 5/52*** | (2006.01) |
| ***E02D 5/24*** | (2006.01) |
| ***E02D 5/54*** | (2006.01) |
| ***E02D 27/50*** | (2006.01) |

(52) U.S. Cl.
CPC ..... *E02D 5/52* (2013.01); *E02D 5/24* (2013.01); *E02D 2600/20* (2013.01); *E02D 2600/40* (2013.01)

(58) Field of Classification Search
CPC .. E02D 5/24; E02D 5/52; E02D 27/42; E02D 27/50; E02D 2600/30; E02D 5/54; E02D 5/80; E04H 12/2215
See application file for complete search history.

(56) References Cited

U.S. PATENT DOCUMENTS 2,942,426 A * 6/1960 Stoll ..... E02D 5/54 405/254
2024/0200298 A1* 6/2024 Nijhof ..... E02D 7/18

FOREIGN PATENT DOCUMENTS

CN 106703023 A * 5/2017 ..... E02D 5/50
CN 115369865 A * 11/2022 ..... E02D 27/44
EP 590367 A1 * 4/1994 ..... E01F 9/685
KR 101191286 B1 * 10/2012
WO WO-2015059579 A2 * 4/2015 ..... E01F 9/685

* cited by examiner

*Primary Examiner* — Amber R Anderson
*Assistant Examiner* — Stacy N Lawson

(57) ABSTRACT

Ground reinforcement foundation piles combinable in different forms depending on ground conditions include: a striking plate including a first coupling part and a second coupling part having a larger diameter than the first coupling part, which are formed at a lower end of the striking plate; a shaft part including a pointed lowest end portion inserted into a ground, and including a first connection part formed at an upper end of the shaft part and connected to the first coupling part; and a body container part having a hollow cylindrical shape to accommodate the shaft part at a center of the body container part, including a second connection part formed at an upper end of the body container part and connected to the second coupling part, and including a plurality of interference parts formed on a side portion of the body container part to interfere with the ground.

11 Claims, 12 Drawing Sheets

GROUND REINFORCEMENT FOUNDATION PILES COMBINABLE IN DIFFERENT FORMS DEPENDING ON GROUND CONDITIONS

BACKGROUND OF THE INVENTION

1. Field of the Invention

The present invention relates to a foundation pile inserted into the ground by a pile-driving scheme so as to reinforce the ground during the construction of a facility, and more particularly, to a foundation pile capable of configuring various combinations of foundation piles having suitable structures according to ground conditions such as hard ground and soft ground, thereby reducing a manufacturing cost through unitization and increasing practicality.

2. Description of the Related Art

Pile-driving foundation piles are formed of various materials, but are mainly steel piles. The foundation piles are used in household structures as well as large structures as main components of a foundation structure having strength and durability, and spotlighted as an efficient and economical foundation construction scheme especially for small structures.

The steel piles are mainly formed of steel, and in some cases, a coating (e.g., zinc plating) is applied to the steel pile so as to prevent corrosion. The steel piles include H-shaped piles, steel pipe piles, spiral piles, and the like. The steel pipe piles are mainly used for household structures in order to mainly insert foundation piles into the ground through simple equipment, and the construction is performed by inserting the steel pipe piles into the ground by using pile-driving equipment and the like after supporting the steel pipe piles.

Such foundation piles may stably support loads of small houses, warehouses, decks and the like, and provide stability even on the weak ground. In addition, the foundation piles may prevent household structures from being tilted by ground subsidence over time, promote compaction of the surrounding ground to increase strength, and prevent horizontal movement that may be caused by wind, vibration, and influence of surrounding structures.

In particular, compared to existing concrete ground construction, a small number of foundation piles may provide sufficient support strength, the foundation piles are lightweight and easy to operate, and the foundation piles may be constructed without specialized large equipment, reused after demolition of the structure, and suitable for various ground conditions. Accordingly, the foundation piles are being constructed for various household structures such as decks, small houses, greenhouses, warehouses, fences, and pillars.

For example, Korean Patent Registration No. 10-2127347 (published on Jun. 26, 2020) discloses a technology related to a foundation pile for rapid and solid prop construction, which includes a prop steel pipe pile and an aggregate foundation pile, and enables a simple work structure.

However, such foundation piles have a uniform foundation pile form that may not be adapted to ground conditions, that is, softness of the ground and the like, so that an optimal foundation pile may not be installed in the weak or strong ground or the like. In particular, when the ground condition is different, entire foundation piles have to be manufactured separately, so that a unit manufacturing cost may be increased. In addition, when the foundation pile is inserted into the ground, a coupling force is not very large so that the foundation pile may not stably support the structure above the ground, and thus it is still common to construct concrete structures and the like instead of the foundation piles, which requires a solution.

SUMMARY OF THE INVENTION

Accordingly, one object of the present invention is to provide a foundation pile structure that is adaptable to various ground conditions, so that a foundation pile having a suitable structure may be configured with a single shaft part according to ground conditions such as hard ground and soft ground, thereby providing a technology capable of reducing a manufacturing cost through unitization and increasing practicality.

In addition, another object of the present invention is to provide a foundation pile technology capable of discharging internal moisture and the like while significantly increasing installation stability by using soil and the like after the construction of the foundation pile.

To achieve the objects described above, according to one embodiment of the present invention, there is provided a ground reinforcement foundation pile, in which ground reinforcement foundation piles are combinable in different forms depending on ground conditions, the ground reinforcement foundation pile including: a striking plate including a first coupling part and a second coupling part having a larger diameter than the first coupling part, which are formed at a lower end of the striking plate; a shaft part including a pointed lowest end portion inserted into a ground to support a structure, and including a first connection part formed at an upper end of the shaft part and connected to the first coupling part; and a body container part having a hollow cylindrical shape to accommodate the shaft part at a center of the body container part, including a second connection part formed at an upper end of the body container part and connected to the second coupling part, and including a plurality of interference parts formed on a side portion of the body container part to interfere with the ground, wherein various types of foundation piles are manufactured and supplied according to combinations of various types of the striking plate, the shaft part, and the body container part.

The first coupling part and the second coupling part, which have cylindrical structures having female screw threads formed on inner sides of the cylindrical structures, may be coupled to the first connection part and the second connection part, which have male screw threads formed on outer sides of the first connection part and the second connection part, respectively, before being inserted into the ground through striking on the striking plate so as to form and provide a foundation pile.

The interference parts may include a plurality of blades formed radially on an outer circumferential surface of the body container part.

The blade may have a plurality of circumferential widths depending on a form of the ground so that various types of body container parts are provided.

At least a lowest end of the blade in an axial direction of a main body of the body container part may be located at a lowest end of the body container part.

An upper end side of the blade may rise toward a ground surface as the upper end side gradually becomes away from an outer surface of the body container part.

A lateral endmost side of the blade may have a sawtooth structure.

A slide flange may be formed on an end portion of the interference part, which forms a contact region with the body container part, and a guide groove angle part to which the slide flange is fitted so as to allow the interference part to be installed on the body container part may be formed on an outer circumferential surface of the body container part.

A shape of the interference part may be configured in various types so that interference parts having different shapes are able to be installed in the guide groove angle part depending on a condition of the ground, which includes at least softness of the ground.

A plurality of through-holes may be formed through inner and outer sides of the body container part on an outer circumferential surface of the body container part.

The shaft part may include: an arrowhead part forming an end side of the shaft part, formed at a lowest end portion of the shaft part, which is inserted most deeply into the ground when the shaft part is inserted into the ground, and configured to provide resistance against upward separation of the shaft part.

According to the present invention, through connection among a striking plate, a shaft part, and a body container part, the shaft part and the body container part inserted into the ground may be variously configured based on the striking plate, so that one foundation pile can be formed by selectively combining a size of the body container part, a size of the shaft part, and a shape of an interference part, and the foundation pile can be constructed through pile driving. Accordingly, the interference part may be variously configured, so that a foundation pile structure that is adaptable to various ground conditions, insertion depths, and the like can be provided, and thus a foundation pile having a suitable structure can be configured according to ground conditions such as hard ground and soft ground, thereby reducing a manufacturing cost through unitization and increasing versatility and practicality.

In addition, fluids such as water can be drained to an outside through a through-hole formed in at least one of the shaft part and the body container part even when the fluids are located in an inside of the body container part due to rain or the like after the construction of the foundation pile, and soil may be inserted to connect the inside and the outside of the body container part through the through-hole so that installation stability can be greatly increased, and in particular, the installation stability can be increased through connection between a reinforcing device such as cement and the ground, which is an installation target of the foundation pile.

DETAILED DESCRIPTION OF THE INVENTION

Hereinafter, various embodiments and/or aspects will be disclosed with reference to the drawings. In the following description, for the purpose of description, numerous specific details are set forth in order to facilitate an overall understanding of one or more aspects. However, it will also be appreciated by a person having ordinary skill in the art to which the present invention pertains that such aspect(s) may be practiced without the specific details. The following description and the accompanying drawings will be set forth in detail for specific illustrative aspects among the one or more aspects. However, the aspects are provided for illustrative purposes, some of various schemes based on principles of various aspects may be employed, and descriptions set forth herein are intended to include all the aspects and equivalents thereof.

The terms "embodiment", "example", "aspect", "illustration", and the like used herein may not be construed as indicating that any aspect or design set forth herein is preferable or advantageous over other aspects or designs.

In addition, it is to be understood that the terms "include" and/or "comprise" indicate the presence of corresponding features and/or elements, but do not preclude the presence or addition of one or more other features, elements, and/or groups thereof.

In addition, although the terms including ordinal numbers such as "first" and "second" may be used to describe various elements, the elements are not limited by the terms. The above terms are used merely for the purpose of distinguishing one element from another element. For example, a first element may be termed as a second element, and similarly, a second element may also be termed as a first element without departing from the scope of the present invention. The term "and/or" includes any combination of a plurality of described relevant items, or one of the described relevant items.

In addition, unless defined otherwise, all terms used in embodiments of the present invention, including technical and scientific terms, have the same meaning as those commonly understood by a person having ordinary skill in the art to which the present invention pertains. Any terms as those defined in generally used dictionaries are to be interpreted to have the meanings consistent with the contextual meanings in the relevant field of art, and are not to be interpreted to have idealistic or excessively formalistic meanings unless explicitly defined in the embodiments of the present invention.

Figure 1:
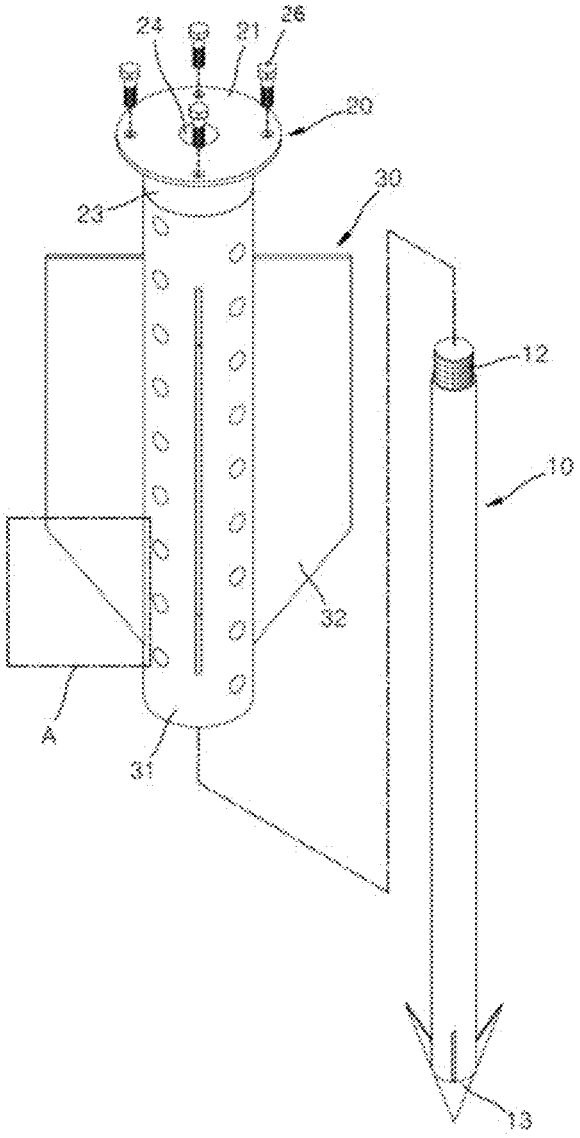
FIG. 1 is a perspective view showing a concept of ground reinforcement foundation piles combinable in different forms depending on ground conditions according to one embodiment of the present invention.
Figure 2:
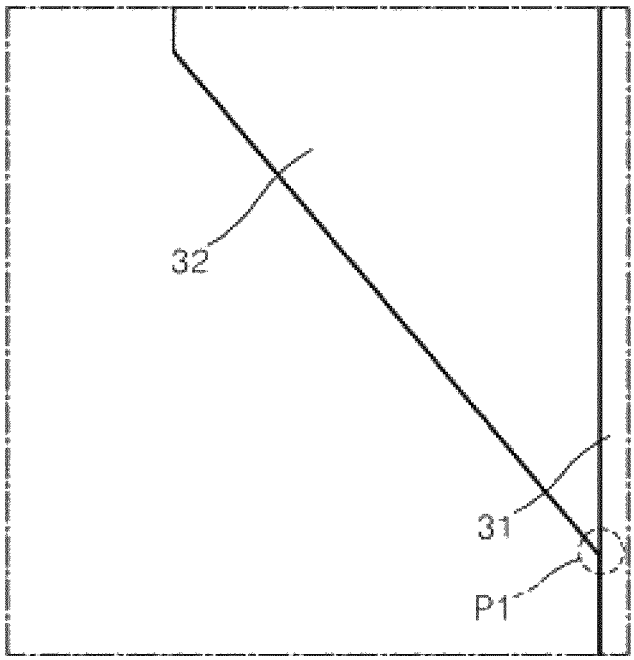
FIGS. 2 to 4 are views showing partial configurations to show technical features of interference parts according to respective embodiments of the present invention.
Figure 3:
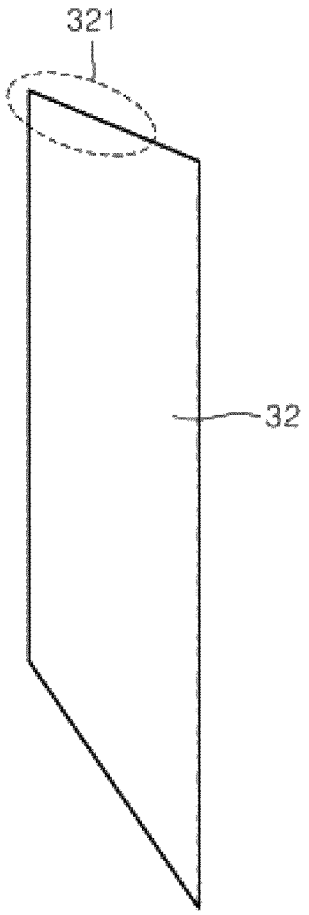
Figure 4:
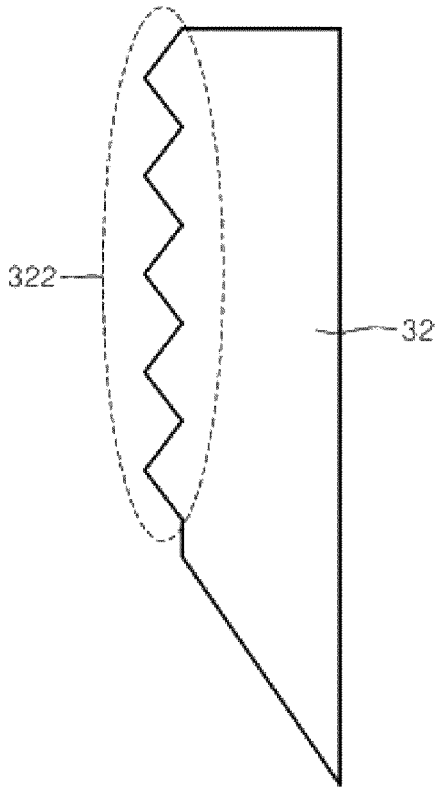
Figure 5:
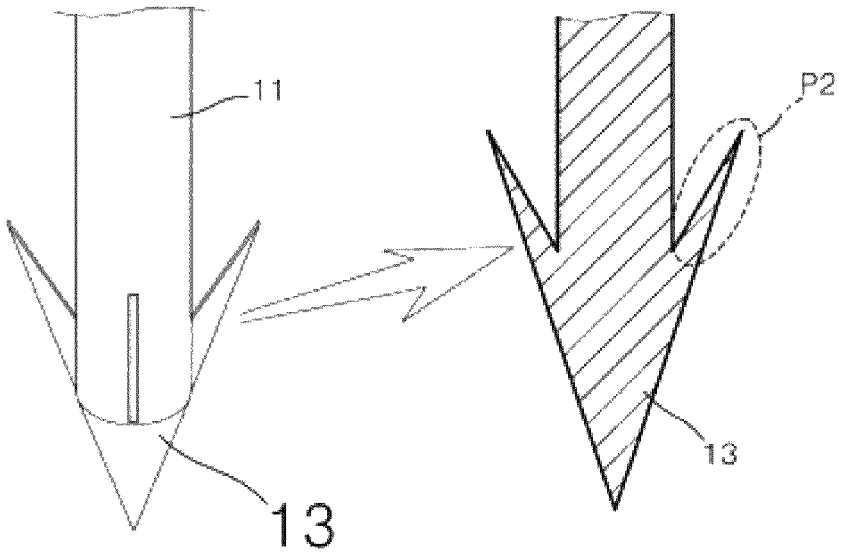
FIG. 5 is a view showing a partial configuration to show a feature of a shaft part according to one embodiment of the present invention.
Figure 6:
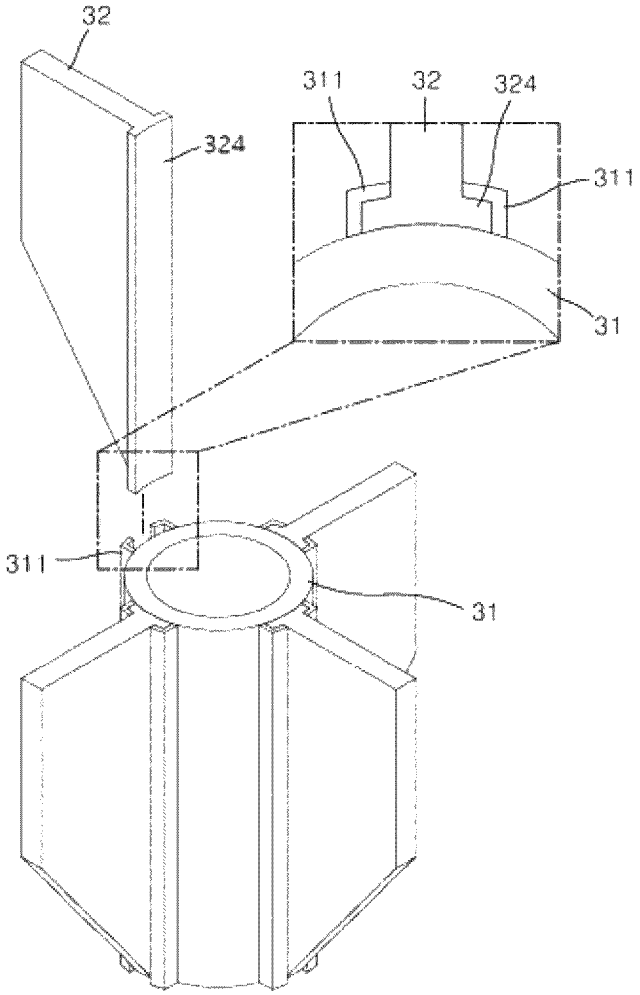
FIG. 6 is a view showing a partial configuration to describe a detachable structure of an interference part according to another embodiment of the present invention.
Figure 7A:
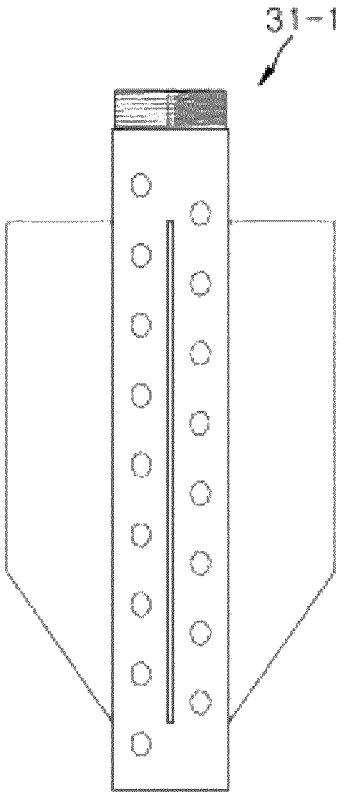
FIGS. 7A to 7D are views for describing examples of shapes of interference parts according to respective embodiments of the present invention.
Figure 7B:
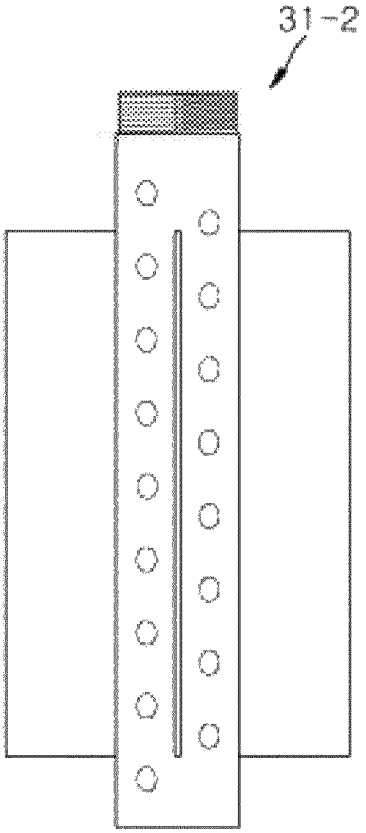
Figure 7C:
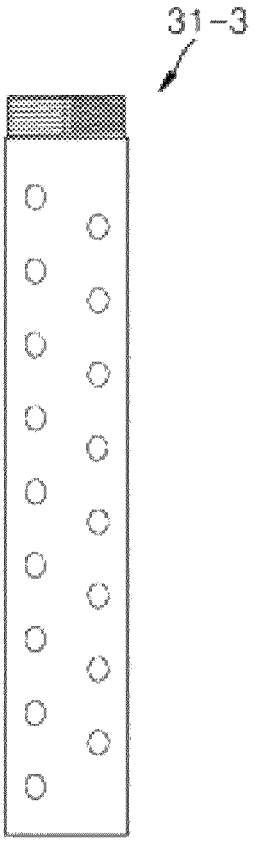
Figure 7D:
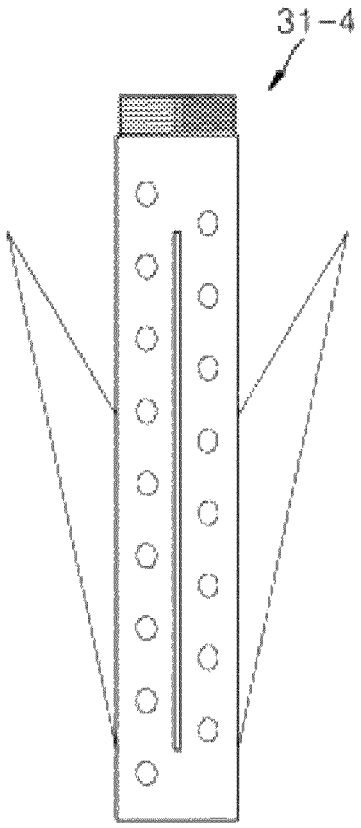
Figure 8:
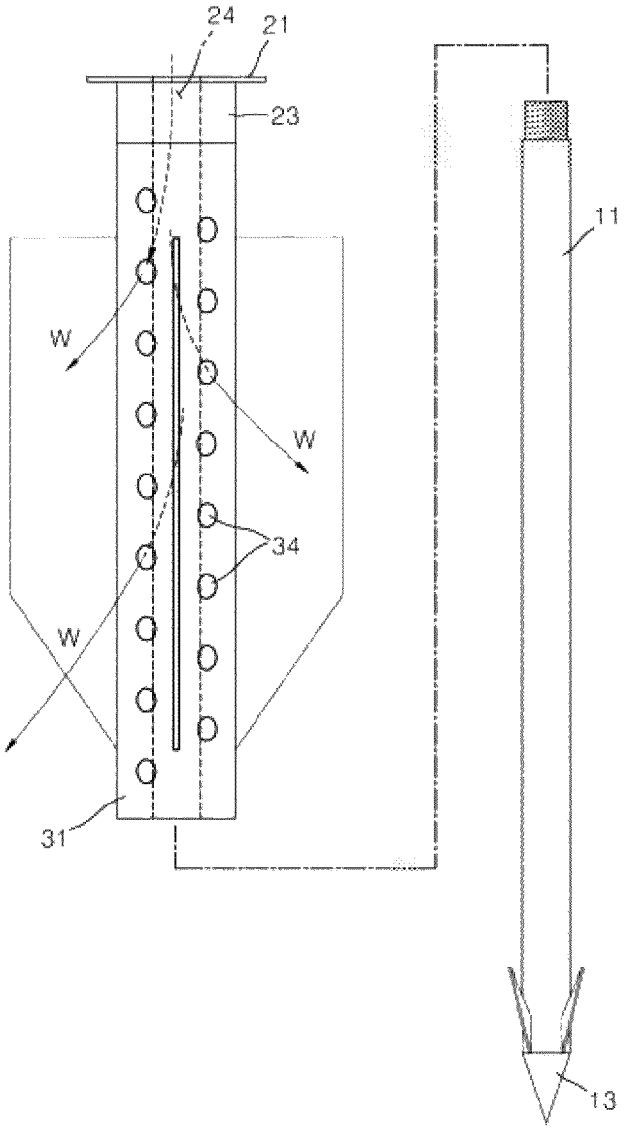
FIG. 8 is a view showing a separation state of respective components of a foundation pile to describe technical features of a through-hole according to one embodiment of the present invention.
Figure 9:
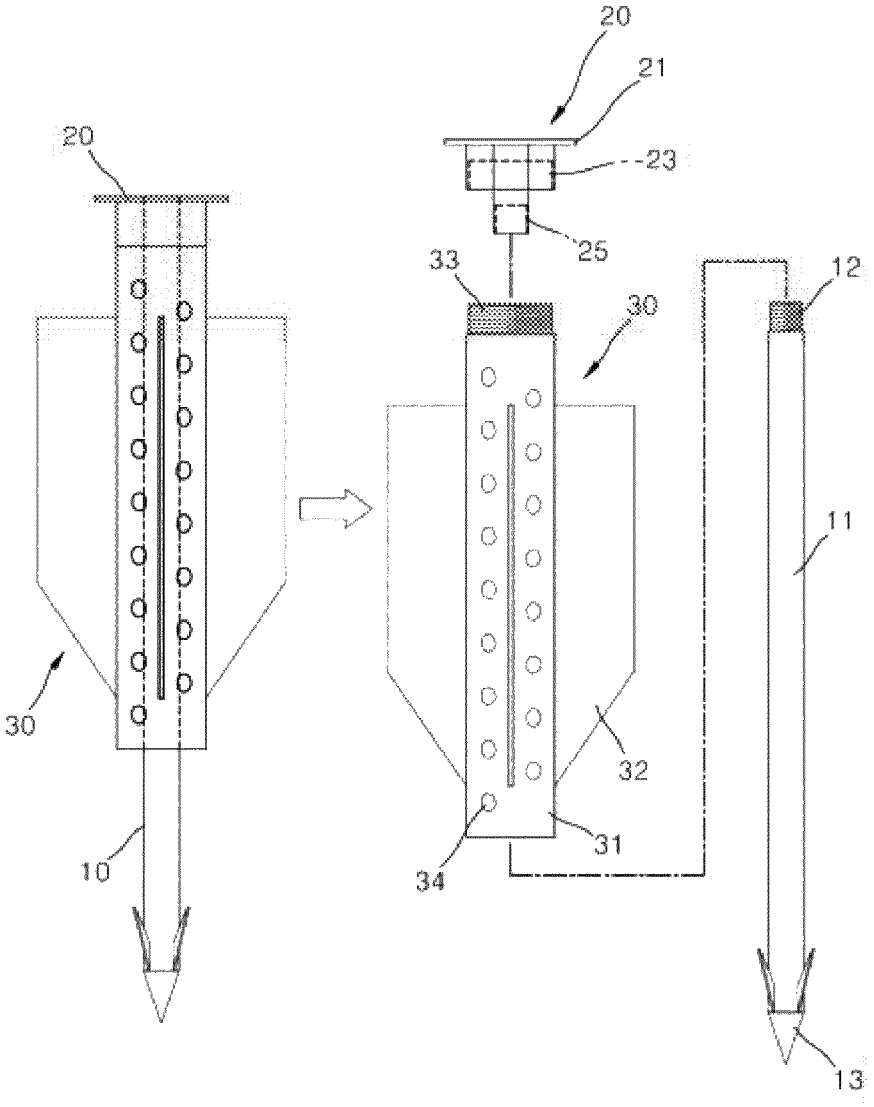
FIG. 9 is a view showing a coupling state and a separation state of ground reinforcement foundation piles combinable in different forms depending on ground conditions according to one embodiment of the present invention.

FIG. 1 is a perspective view showing a concept of ground reinforcement foundation piles combinable in different forms depending on ground conditions according to one embodiment of the present invention, FIGS. 2 to 4 are views showing partial configurations to show technical features of interference parts according to respective embodiments of the present invention, FIG. 5 is a view showing a partial configuration to show a feature of a shaft part according to one embodiment of the present invention, FIG. 6 is a view showing a partial configuration to describe a detachable structure of an interference part according to another embodiment of the present invention, FIGS. 7A to 7D are views for describing examples of shapes of interference parts according to respective embodiments of the present invention, FIG. 8 is a view showing a separation state of respective components of a foundation pile to describe technical features of a through-hole according to one embodiment of the present invention, and FIG. 9 is a view showing a coupling state and a separation state of ground reinforcement foundation piles combinable in different forms depending on ground conditions according to one embodiment of the present invention.

Meanwhile, in the following description, although some components shown in the drawings have been omitted or excessively enlarged or reduced in order to describe a function of each of the components of the present invention, it is to be understood that the details shown in the drawings do not limit the technical features and scope of the present invention.

In addition, in the following description, a plurality of drawings may be simultaneously referenced in order to describe one technical feature or one element constituting the invention.

To describe with reference to the drawings, ground reinforcement foundation piles combinable in different forms depending on ground conditions according to one embodiment of the present invention (hereinafter referred to as a "foundation pile according to the present invention") may include a shaft part 10, a striking plate 20, and a body container part 30.

The shaft part 10 may refer to a column-shaped or bar-shaped structure inserted into the ground to support a structure. As shown in FIG. 1, the shaft part 10 may refer to a structure that forms a lowest end portion of the foundation pile according to the present invention, which is inserted most deeply into the ground, and that pierces the ground so as to be inserted into the ground. Accordingly, as shown in FIG. 1, a lowest end of the shaft part 10 may have a pointed end portion 13 to facilitate insertion by penetrating into the ground upon the insertion into the ground by the pile driving.

The striking plate 20 coupled to the shaft part 10 may refer to a structure that allows only an uppermost surface of the striking plate 20 to be exposed above the ground while a portion of the foundation pile corresponding to the body container part 30 and the shaft part 10 is inserted into the ground through the pile driving when the foundation pile is completed. According to various embodiments of the present invention, the striking plate 20 may also have a meaning of a coupling body connected to the body container part 30 and the shaft part 10 to form the foundation pile.

As shown in FIG. 9, the striking plate 20 may include a first coupling part 25 and a second coupling part 23. As shown in FIG. 9, the first coupling part 25 may have a smaller diameter than the second coupling part 23, and in particular, the first coupling part 25 and the second coupling part 23 may have a concentric structure, so that when the shaft part 10 and the body container part 30 are coupled to the striking plate 20 as will be described below, the shaft part 10 and the body container part 30 may also have a concentric structure.

The shaft part 10 may be configured such that the end portion 13 is formed at a lowest end of a main shaft 11 as described above. In other words, the shaft part 10 may have a pointed lowest end portion 13 inserted into the ground to support the structure. Meanwhile, a first connection part 12 connected to the first coupling part 25 may be formed on an opposite end side of an end side on which the end portion 13 is formed, that is, at an upper end of shaft part 10.

Accordingly, in order for the shaft part 10 to form the foundation pile, the first connection part 12 may be connected to the first coupling part 25, so that shaft parts 10 having various sizes and shapes may be coupled. In particular, when only a size of the first connection part 12 is the same, the foundation pile may be variously configured by allowing a diameter and a length of the shaft part 10 and a shape of the end portion 13 that will be described below to vary.

As shown in FIGS. 1 and 9 and the like, the body container part 30 may refer to a container-shaped structure having a hollow cylindrical shape to accommodate the shaft part 10 at a center of the body container part 30, including a second connection part 33 formed at an upper end of the body container part 30 and connected to the second coupling part 23, and including a plurality of interference parts 32 formed on a side portion of the body container part 30 to interfere with the ground.

Similar to the shaft part 10 described above, the body container part 30 may include a second connection part 33 formed at the upper end of the body container part 30 and connected to the second coupling part 23 formed on the striking plate 20 so that a main body 31 of the body container part 30 may be coupled to the striking plate 20. In other words, accordingly, body container parts 30 having various sizes and shapes may be coupled to the striking plate 20. In particular, when only a size of the second connection part 33 is the same, the foundation pile may be further variously configured by allowing a diameter and a length of the body container part 30, a shape and a size of the interference part 32, and the like to vary.

According to the present invention, since the shaft part 10 has a column shape, the first connection part 12 may have a column-shaped structure having a male screw thread formed on an outer side of the column-shaped structure, and the first coupling part 25 may have a cylindrical structure having a female screw thread formed on a container-shaped inner wall, that is, an inner side of the cylindrical structure. In addition, similarly, the second connection part 33 may have a male screw thread formed on an outer side of the second connection part 33, and the second coupling part 23 may have a female screw thread formed on a container-shaped inner wall, that is, an inner side of the second coupling part 23 so as to correspond to the second connection part 33.

In this way, the striking plate 20, the shaft part 10, and the body container part 30 may be connected to each other through coupling of the first and second coupling parts 25 and 23 and the first and second connection parts 12 and 33, respectively. Before being inserted into the ground through striking on the striking plate 20, the striking plate 20, the shaft part 10, and the body container part 30 may be coupled to each other to form and provide the foundation pile.

In other words, for example, various shapes of the shaft part 10 and the body container part 30 may be configured depending on ground conditions. When different shaft parts 10 and body container parts 30 are coupled to the striking plate 20 depending on ground conditions so as to provide a foundation pile, and the striking plate 20 is pile-driven so as to be inserted into the ground at the site, a foundation pile having sufficient support strength and ease of insertion may be provided in advance depending on a great variety of ground conditions. In addition, the striking plate 20 may be replaced or selectively used to have various structures depending on structures, so that versatility may be greatly increased.

After the foundation pile is constructed, a process of installing the structure on the foundation pile may be performed, for example, by a bolt-coupling scheme through a bolt 26 and a connection hole 22. In addition, even when an additional support structure or the like is installed on the striking plate 20, the additional support structure may be installed by the bolt-coupling scheme through the bolt 26 and the connection hole 22, so that the foundation pile may be easily constructed depending on ground conditions and ground surface conditions.

According to the present invention, the striking plate 20 may be a striking target of pile-driving equipment during the pile driving as described above, and may perform a function of a flange that allows various structures to be installed through a hollow part 24 together with the bolt 26 and the connection hole 22. Accordingly, a size and a shape of the striking plate 20, a position of the connection hole 22, the number of connection holes 22, a sectional shape and a size of the hollow part 24, and the like may be variously configured.

As shown in FIG. 1 and the like, an interference part 32 may be arranged on a side portion of the body container part 30 to interfere with the ground so as to maintain a stable installation state and prevent rotation of the foundation pile in which the body container part 30, the striking plate 20, and the shaft part 10 are coupled to each other while further increasing support strength of the structure with respect to the ground.

As shown in FIG. 1, the interference part 32 may have a shape of a kind of blade, and may be installed in a height direction along the side portion and an outer circumferential surface of the body container part 30, and a plurality of interference parts 32 may be preferably installed radially. As described above, a main function of the interference part 32 may be to solve a problem that when the foundation pile in which the striking plate 20, the shaft part 10, and the body container part 30 are coupled to each other is inserted into the ground, due to high softness of the ground, the foundation pile rotates in the ground without being stably fixed to the ground so that the structure is not stably fixed and installed by the foundation pile on a ground surface.

Since an existing foundation pile has to be produced as one product as described above, various types of products have to be produced depending on ground conditions such as softness of the ground. In other words, the ground may be relatively hard so as not to require a blade (because the blade rather hinders the installation upon pile-driving insertion), the ground may be soft so as to require a blade, or various shapes of blades may be required depending on the softness.

However, according to the present invention, the body container part 30 may have various shapes, and the striking plate 20, the shaft part 10, and the body container part 30 may be produced in the form of units and appropriately coupled and connected to each other depending on ground conditions instead of separately producing the entire foundation pile, so that various combinations of foundation piles may be manufactured.

Meanwhile, as shown in FIG. 2, in order to stably fix the blade to the body container part 30 and maximize an interference force, when the blade, that is, the interference part 32 is installed on the main body 31 of the body container part 30, a lowest end, that is, a lowest end point P1 of the blade in an axial direction of the main body 31 of the body container part 30 may be preferably located at a lowest end of the main body 31 of the body container part 30.

In addition, as described above, a size of the blade of the interference part 32 has to be configured to minimize rotation of the main body 31 depending on ground conditions, that is, the softness of the ground and the like. Further, as described above, there is a limitation that interference with the insertion into the ground caused by a shape and a size of the blade has to be minimized.

Accordingly, the blade, that is, the interference part 32 may have a size configured to have a plurality of circumferential widths depending on a form of the ground, which is at least the softness of the ground or the like, so that various types of body container parts 30 that may be connected to one shaft part 10 may be provided as described above.

The shape of the blade may be provided in a great variety of forms with a size of the circumferential width described above. In other words, referring to FIGS. 7A to 7D, for example, when an insertion force is to be maximized upon installation on the very hard ground, that is, when there is no concern about rotation and the like, a body container part 31-3 of FIG. 7C in which an interference part such as a blade is minimized may be provided. Meanwhile, in a case of the general ground with predetermined softness, a body container part 31-1 having a blade having a basic shape as shown in FIG. 1 and FIG. 7A and the like may be provided. Meanwhile, when the softness is high so that large resistance to rotation is required without requiring a large insertion force, a body container part 31-2 having a blade having a shape as shown in FIG. 7B may be provided.

Meanwhile, in a case of an installation form in which there is a concern of upward separation due to characteristics of an external force applied to the structure and the like, a body container part 31-4 having a blade having a shape in which a height-direction inclination of an upper end side is large may be provided as shown in FIG. 7D.

Meanwhile, as described above, the interference part 32 may perform a function of preventing the body container part 30 and the shaft part 10 from rotating in the ground. When the interference part 32 functions to withstand an external force in an upward-downward direction at the same time, the interference part 32 may simultaneously have resistance to a rotational force and resistance to the external force in the upward-downward direction, so that the foundation pile may be installed more stably in the ground.

To this end, as shown in FIG. 3, an upper end side 321 of the blade may be inclined to rise toward the ground surface as the upper end side 321 gradually becomes away from an outer surface of the main body 31 of the body container part 30. In this case, when the upper end side 321 as shown in FIG. 3 is inserted into the ground as the installation of the foundation pile is completed, the upper end side 321 may have resistance to an external force toward the ground surface due to a pointed shape of an upper side of the blade through interference with the ground in the ground, thereby enabling stable fixing.

In order to additionally provide resistance to an external force in a rotation direction while further restricting upward movement as described above, according to another embodiment of the present invention, a lateral endmost side 322 of the blade may have a sawtooth structure as shown in FIG. 4.

Accordingly, resistance to downward movement as well as the upward movement may be simultaneously generated according to the sawtooth structure described above so that installation stability of the foundation pile may be greatly increased, and predetermined resistance may be provided even in the rotation direction according to characteristics of the sawtooth structure.

A limiting force for the upward movement may be provided the shaft part 10 as well as the body container part 30. In other words, as described above, a lower end portion 13 of the shaft part 10 may have an end side having a pointed shape in order to increase an insertion force. In this case, as shown in FIG. 5, the end side of the lower end portion 13 may include an arrowhead part having an arrowhead-like structure P2.

In other words, the arrowhead part may form the end side of the lower end portion 13 of the shaft part 10, and may be formed at a lowest end portion of the shaft part 10, which is inserted most deeply into the ground when the shaft part 10 is inserted into the ground. In this case, when the shaft part 10 is inserted into the ground, the arrowhead part may have a shape that is similar to the upper end side 321 of the blade 32 described above so as to provide resistance against upward separation.

Meanwhile, as the range of use of the foundation pile increases, a great variety of shapes of the blades, that is, the interference parts 32 may be required. This is because the interference part may have a great variety of shapes depending on the form of the ground, a type and a size of the structure to be installed, and the like as mentioned in the above description of FIGS. 7A to 7D.

In this case, manufacturing various types of body container parts 30 as in the embodiment described above may reduce an effect of the present invention described above, which is the reduction of the manufacturing cost. In other words, in order to solve the problem described above, types of the body container parts 30 may be minimized, and a detachable structure of the body container part 30 and the interference part 32 may be provided, so that the body container part 30 may be simply divided into a case where the interference part 32 is installed and a case where the interference part 32 is not installed, and the interference part 32 having various shapes may be detachably attached to the body container part 30, thereby maximizing the reduction of the manufacturing cost due to the reduction of the types of the body container parts 30.

To this end, referring to the configuration shown in FIG. 6, a slide flange 324 that enables installation through sliding may be formed on an end portion of the interference part 32, which forms a contact region, that is, a coupling region with the body container part, and a guide groove angle part 311 to which the slide flange 324 is fitted so as to allow the interference part 32 to be slidably coupled to the body container part 30 may be formed on the outer circumferential surface of the body container part 30.

In this case, when the interference part 32 is installed while moving upward through the slide flange 324 from an end side of the guide groove angle part 311 formed at a lowest end of the interference part 32 as shown in FIG. 6, an upper end of the interference part 32 may hit the striking plate 20 so as to limit movement of the interference part 32 as shown in FIGS. 7A to 7D, or although not shown in FIG. 6, a blocking wall of the guide groove angle part may be formed on an upper end side of the interference part 32 so as to limit upward movement of the interference part 32 in an embodiment where the upper end side 321 of the blade is inclined and the like.

In this case, when various types of interference parts 32 having different shapes are installed in the guide groove angle part 311 as described above depending on a condition of the ground, which includes the softness of the ground, that is, the form of the ground, a foundation pile having high adaptability to various types of ground conditions may be provided with only a very small number of types of body container parts 30.

Meanwhile, in a case where soil is supplied inside the foundation pile to increase a fixing force according to construction of the foundation pile and the like, when connection is achieved between the supplied soil and an insertion target ground, an installation fixing force may be greatly increased while solving a drainage problem described above. Meanwhile, for example, upon construction of a reinforcing device such as cement in the hollow part 24, when the cement is partially supplied into the insertion target ground from the hollow part 24 and an inner cavity 14, the installation fixing force described above may be greatly increased.

In consideration of such various needs, as shown in FIG. 8, a plurality of through-holes 34 may be formed through the body container part 30 to connect an inner wall and an outside of the body container part 30 at a plurality of points on the outer circumferential surface of the body container part 30.

Accordingly, moisture may pass between inner and outer walls of the body container part 30 through the through-hole 34, or the reinforcing device such as soil or cement may connect the inner and outer walls of the body container part 30 to each other, so that soil inside the body container part 30 and soil outside the body container part 30 or other fixing device may be connected to each other.

Although the above description has been made with reference to specific embodiments and drawings, it will be under stood by a person having ordinary skill in the art that various modifications and changes can be made from the above description. Since the term such as "include", "comprise", or "have" described above means that the corresponding element may be inherent unless explicitly stated to the contrary, it is to be interpreted that other elements may be further included but not excluded. In addition, the scope of the present invention is to be interpreted by the appended claims, and construed as encompassing all technical ideas within the scope of equivalents thereof.

What is claimed is:

1. A ground reinforcement foundation pile being configurable depending on ground conditions, the ground reinforcement foundation pile comprising:

a striking plate including a first coupling part and a second coupling part having a larger diameter than the first coupling part, the first and second coupling parts-being formed at a lower end of the striking plate;

a shaft part including a pointed lowest end portion configured to be inserted into a ground to support a structure, and including a first connection part formed at an upper end of the shaft part and connected to the first coupling part; and a body container part having a hollow cylindrical shape to accommodate the shaft part at a center of the body container part, including a second connection part formed at an upper end of the body container part and connected to the second coupling part, and a plurality of interference parts configured to be received on a side portion of the body container part to interfere with the ground, wherein the ground reinforcement foundation pile is configurable by combining different sizes and/or shapes of the striking plate, the shaft part, and the body container part; and wherein the body container part is configured with one or more guide groove angle parts extending in parallel with a length of the body container part, wherein each guide groove angle part has a length that runs substantially parallel to a longitudinal axis of the body container part and that allows a respective one of the interference parts to slide into one end of the guide groove angle part and to move along the length of the body container part once the interference part has been inserted into the guide groove angle part, and wherein the respective interference part remains slidable within the guide groove angle part during installation of the ground reinforcement foundation pile, each guide groove angle part comprising (1) a pair of side walls with bent end portions on an outer surface of the body container part defining a space for containing the respective interference part corresponding to each guide groove angle part, said bent end portions extending at an angle from an edge of each side wall, and (2) a partially open top surface, defined by the bent end portions, which extends along the length of the body container part for sliding the respective interference part into the guide groove angle part while securely holding the interference part in place within the guide groove angle part.

2. The ground reinforcement foundation pile of claim 1, wherein the first coupling part and the second coupling part, which have cylindrical structures having female screw threads formed on inner sides of the cylindrical structures, are coupled to the first connection part and the second connection part, which have male screw threads formed on outer sides of the first connection part and the second connection part, respectively, before being inserted into the ground through striking on the striking plate so as to form and provide a foundation pile.

3. The ground reinforcement foundation pile of claim 1, wherein the interference parts include a plurality of blades configured to extend radially from the outer surface of the body container part.

4. The ground reinforcement foundation pile of claim 3, wherein each of the blades has a circumferential width selected based on the ground properties.

5. The ground reinforcement foundation pile of claim 3, wherein at least a lowest end of each of the blades in an axial direction of a main body of the body container part is located at a lowest end of the body container part.

6. The ground reinforcement foundation pile of claim 3, wherein an upper end side of each of the blades rises toward a ground surface as the upper end side gradually extends from the outer surface of the body container part.

7. The ground reinforcement foundation pile of claim 3, wherein a lateral endmost side of each of the blades has a sawtooth structure.

8. The ground reinforcement foundation pile of claim 1, wherein a slide flange is formed on an end portion of each of the interference parts, which forms a contact region with the body container part, and the guide groove angle part to which the slide flange is fitted so as to allow each of the interference parts to be installed on the body container part is formed on the outer circumferential surface of the body container part.

9. The ground reinforcement foundation pile of claim 8, wherein the ground reinforcement foundation pile is configurable by installing different shapes of the interference parts depending on a condition of the ground.

10. The ground reinforcement foundation pile of claim 1, wherein a plurality of through-holes are formed on the outer surface of the body container part.

11. The ground reinforcement foundation pile of claim 1, wherein the shaft part includes:

an arrowhead part forming a side of the lowest end portion of the shaft part, wherein the lowest end portion is inserted most deeply into the ground when the shaft part is inserted into the ground.

* * * * *